US007739956B2

(12) United States Patent
Ljungwald et al.

(10) Patent No.: US 7,739,956 B2
(45) Date of Patent: Jun. 22, 2010

(54) INTERNAL PRESSURE RELIEVING DEVICE FOR ANTI-ARMOUR AMMUNITION

(75) Inventors: Niclas Ljungwald, Eskilstuna (SE); Peter Tuikkanen, Eskilstuna (SE)

(73) Assignee: SAAB AB, Linköping (SE)

( * ) Notice: Subject to any disclaimer, the term of this patent is extended or adjusted under 35 U.S.C. 154(b) by 689 days.

(21) Appl. No.: 11/653,938

(22) Filed: Jan. 17, 2007

(65) Prior Publication Data

US 2010/0122640 A1 May 20, 2010

(30) Foreign Application Priority Data

Jan. 17, 2006 (EP) ..... 06100441

(51) Int. Cl.
*F41A 17/16* (2006.01)

(52) U.S. Cl. ..... 102/481; 89/1.7

(58) Field of Classification Search ..... 102/481; 89/1.7

See application file for complete search history.

(56) References Cited

U.S. PATENT DOCUMENTS

| | | | | | |
|---|---|---|---|---|---|
| 3,052,091 | A | * | 9/1962 | D Ooge | 102/374 |
| 3,173,364 | A | * | 3/1965 | Nordzell | 102/481 |
| 3,927,791 | A | * | 12/1975 | Hershberger | 102/481 |
| 3,972,289 | A | * | 8/1976 | Morris | 102/200 |
| 4,084,512 | A | * | 4/1978 | San Miguel | 102/481 |
| 4,458,482 | A | * | 7/1984 | Vetter et al. | 102/481 |
| 4,478,151 | A | * | 10/1984 | Vetter et al. | 102/481 |
| 4,494,373 | A | * | 1/1985 | Vetter et al. | 102/481 |
| 5,035,180 | A | | 7/1991 | Purcell et al. | |
| 5,035,181 | A | * | 7/1991 | Jacks et al. | 102/481 |
| 5,035,182 | A | | 7/1991 | Purcell et al. | |
| 5,129,326 | A | * | 7/1992 | Brogan | 102/481 |
| 5,155,298 | A | * | 10/1992 | Koontz | 102/481 |
| 5,228,285 | A | * | 7/1993 | Van Name et al. | 102/481 |
| 5,361,703 | A | * | 11/1994 | Braithwaite | 102/481 |
| 5,466,537 | A | * | 11/1995 | Diede et al. | 102/481 |
| 5,735,114 | A | * | 4/1998 | Ellingsen | 102/481 |
| 5,786,544 | A | * | 7/1998 | Gill et al. | 102/481 |
| 5,813,219 | A | * | 9/1998 | Gill et al. | 102/481 |
| 6,321,656 | B1 | * | 11/2001 | Johnson | 102/481 |

(Continued)

FOREIGN PATENT DOCUMENTS

GB 2242008 A 9/1991

OTHER PUBLICATIONS

European Search Report issued in priority application May 29, 2006.

*Primary Examiner*—Michael Carone
*Assistant Examiner*—Jonathan C Weber
(74) *Attorney, Agent, or Firm*—Venable LLP; Eric J. Franklin

(57) ABSTRACT

An internal pressure relieving device for anti-armour ammunition. The device is mainly adapted for use with barrel-loaded ammunition, that is a naked round including a cartridge case, which normally would be located in its packaging. A plurality of slot formed openings have been cut out through a wall of the cartridge case and the openings have been sealed by inserts of polymeric plastic introduced with a tight fit into each opening. Hence, by the characteristics of the plastic material, the inserts can be configured to open up at a predetermined level of temperature. Alternatively, the inserts open up at a predetermined level of pressure in the cartridge case.

6 Claims, 2 Drawing Sheets

U.S. PATENT DOCUMENTS

| | | | | |
|---|---|---|---|---|
| 6,338,242 | B1 * | 1/2002 | Kim et al. | 102/481 |
| 6,615,737 | B2 * | 9/2003 | Bonnel et al. | 102/481 |
| 6,952,995 | B2 * | 10/2005 | Friedlander, III | 102/481 |
| 7,025,000 | B1 * | 4/2006 | Wong et al. | 102/481 |
| 7,051,511 | B2 * | 5/2006 | Prytz | 102/377 |
| 7,377,690 | B1 * | 5/2008 | Diede | 102/377 |
| 7,451,703 | B1 * | 11/2008 | Dabiri | 102/481 |
| 7,530,314 | B2 * | 5/2009 | Skinner et al. | 102/378 |
| 2003/0010246 | A1 * | 1/2003 | Bonnel et al. | 102/481 |
| 2009/0183648 | A1 * | 7/2009 | Skinner et al. | 102/481 |

* cited by examiner

INTERNAL PRESSURE RELIEVING DEVICE FOR ANTI-ARMOUR AMMUNITION

CROSS-REFERENCE TO RELATED APPLICATIONS

This application claims priority to European patent application 06100441.2 filed 17 Jan. 2006.

BACKGROUND OF THE INVENTION

1. Technical Field of the Invention

The present invention relates to a device for preventing an unintentional increase of internal pressure in a round comprising a shell and a cartridge case assembly with a cartridge case to be loaded in a barrel of a weapon of an anti-armour non-disposable type. More particularly, the invention relates to a device which is mainly adapted for use with barrel-loaded ammunition per se, that is a naked round, which normally would be located in its packaging, for example a double tube of a conventional kind. Even if said cartridge case has no external support when it is not loaded in the barrel, there is a chance of an increase of internal pressure sufficient for fragmentation of the cartridge case or even for disengaging the shell from the cartridge case assembly and detonating it, should the propellant charge of said assembly accidentally ignite.

2. Description of Related Art

When transporting and storing anti-armour ammunition for weapons of the non-disposable type there is in some cases, involving SCO, SD, FCO, BI and FI situations, a potential chance of an accidental firing of the propellant charge. Normally, any accidental firing of the propellant charge could lead to a closely following fragmentation of said round and a possible detonation of the shell, which in turn would lead to possible fatal consequences, especially when the round is situated in an unrestrained manner (naked round). Recent national and local requirements recommend that in any of the above situations no parts shall be expelled more than 15 meters (30 feet). Up till now the related technical field lacks a suitable solution to the present problem.

SUMMARY OF THE INVENTION

One object of the present invention is to provide a device for preventing an unintentional increase of internal pressure in a round of the initially identified kind, should the propellant charge of its cartridge case assembly be accidentally ignited during handling and, whenever applicable, transportation and storage of the naked round, and thereby preventing an accidental fragmentation of the cartridge case or preventing a disengaging of the shell from the cartridge case assembly and detonating it in the vicinity.

This is possible with a device of the initially identified kind comprising a cartridge case, through a wall of which at least one opening has been cut out and that said opening has been sealed by means of a safety member configured to open up at a predetermined level of temperature ($t_1$). Alternatively or additionally said safety member is configured to open up at a predetermined level of pressure ($p_i$) in the cartridge case.

In one embodiment the cartridge case is made of metal and the safety member has the shape of an insert of resilient material introduced with a tight fit into the opening.

Further embodiments, improvements and developments of the device according to the invention appear from the following detailed description and the appended claims with reference to the accompanying schematic drawings. On the drawings, similar or identical items have the same reference numbers.

DETAILED DESCRIPTION OF THE INVENTION

Figure 1:
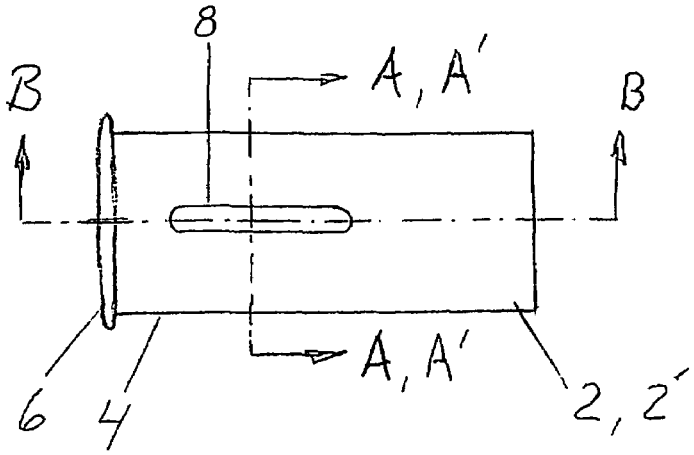
FIG. 1 is a side view of a cartridge case suitable for a weapon of an anti-armour non-disposable type.

FIG. 1 illustrates a side view of a cartridge case 2 suitable to be provided with a not shown shell and further not shown cartridge case assembly components required for a completed round to be loaded in a barrel of a weapon of an anti-armour non-disposable type (not shown). Said cartridge case 2 is preferably made of metal, such as aluminum, brass etc. with a cylindrical wall 4 and a base plate 6 locked to the wall. At least one opening 8 has been cut through the wall of the cartridge case. Preferably, said opening has the form of a longitudinal slot 8, even if it might take any suitable square or annular form or the like.

Figure 2:
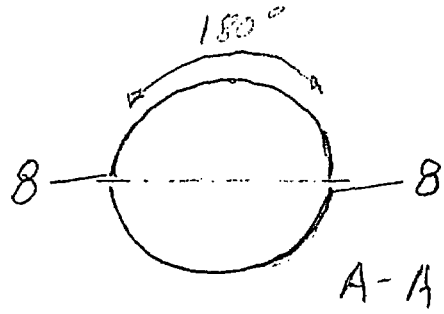
FIG. 2 is a cross section through the line A-A in FIG. 1.

FIG. 2 is a cross section through the line A-A in FIG. 1, which illustrates a cylindrical wall 4 provided with an arrangement of two evenly distributed slots 8, mutually separated by 180°.

Figure 3:
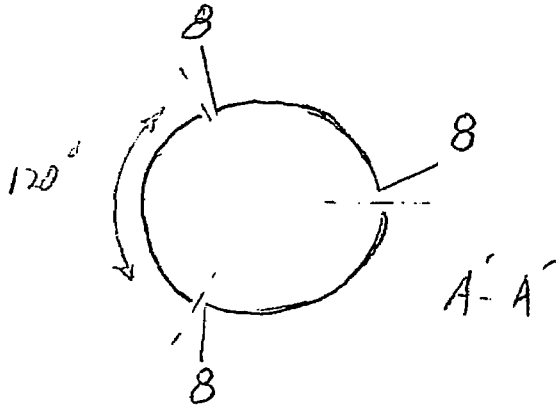
FIG. 3 is a cross section through the line A'-A' in FIG. 1.

FIG. 3 is a cross section through the line A'-A' in FIG. 1, which illustrates a cylindrical wall 4 provided with an arrangement of three evenly distributed slots 8, mutually separated by 120°.

Figure 4:
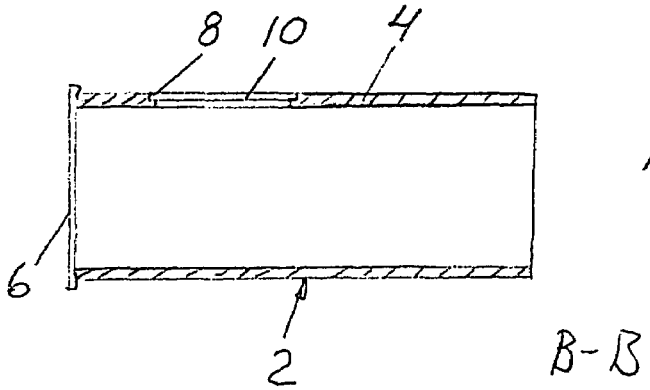
FIG. 4 is a length section through the line B-B in FIG. 1.

FIG. 4 is a length section through the line B-B in FIG. 1, which discloses an example of an slot formed opening 8, with the edge of the opening being stepped to configure a shoulder 10 at the edge of the opening 8.

Figure 5:
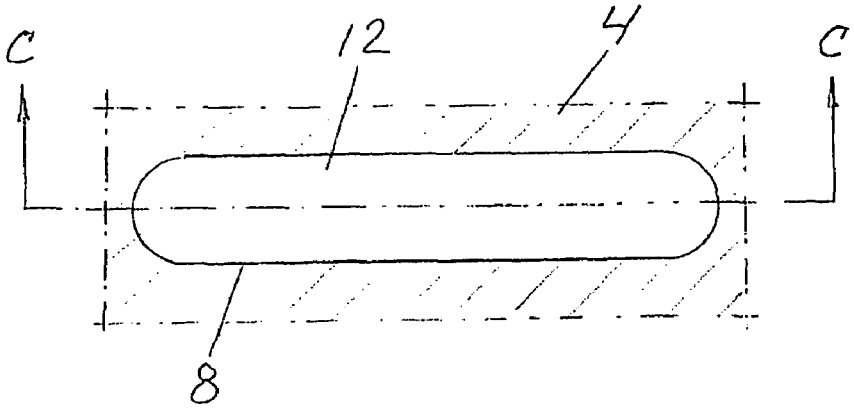
FIG. 5 is a cut out view in greater scale of a piece of the wall of the cartridge case surrounding a slot formed opening with an insert of resilient material introduced into the opening and FIG. 6 is a length sectional view through the line C-C in FIG. 5.

FIG. 5 is a cut out view of a piece of the wall 4 of the cartridge case surrounding said slot formed opening 8, illustrating that that the opening 8 has been sealed by means of a safety member 12. In this embodiment the safety member has been configured the shape of an insert 12 of resilient material, which has been introduced into the opening 8 with a tight fit.

Figure 6:
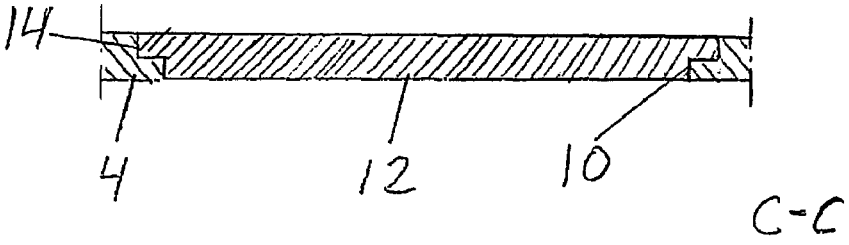

FIG. 6 is a length sectional view through the line C-C in FIG. 5, which illustrates the stepped profile of the edge of the slot formed opening 8. Particularly, it illustrates the stepped profile of the shoulder 10 in cooperation with a rim 14 of said insert 12 made with a stepped, complementary form to said shoulder 10 and bonded to the same.

Advantageously, as appear from FIGS. 2 and 3, a plurality of slot formed openings 8 are evenly distributed around the circumference of the cartridge case 2. Efficiently, if three or more said openings each are arranged with an insert 12, this will enable a stable burn out upon open up of the inserts with only slight or non movements at all of the round, should the propellant charge of the cartridge case assembly accidentally ignite. Accordingly, the above is a simple and efficient solution with no encroachment to the shell itself but only to the cartridge case.

In order to secure that no parts shall be expelled more than 15 meters (30 feet) from the site of an accidentally ignited round, the total area of the slot formed openings 8 should correspond to the area of the base plate 6 of the cartridge case.

As an example, the cartridge case 2 is provided with six slot formed openings 8 evenly distributed around its circumference. For a base plate 6 with a diameter of 73 mm, each of said openings is 200 mm long and 2-5 mm, preferably 3.5 mm wide. The resilient inserts 12 might be of a rubber or plastic material, which might be pressed, forged etc. or glued into each opening 8. Hence, a material having a relatively low modulus of elasticity and degree of hardness compared to the material in said wall 4 of the cartridge case. Alternatively, each insert might be shaped as a cover located over the opening and glued onto the outer surface of the cartridge case. In some cases the material of each insert might be provided with a primer, in order to achieve appropriate compatibility with the certain powder compositions.

The material in the inserts will soften and finally melt under influence of temperatures above its softening temperature. Therefore, it is achievable to control the opening procedure of each insert depending on the chosen material. A suitable material would be a polymeric plastic, which typically has a softening temperature level $t_1$ of app. 90° C. This temperature is significantly below the ignition temperature of 130° C. for the powder (igniter composition and propellant charge) and well above the specified temperature for the field of application of this ammunition (−51° C.-+71° C.).

Results revealed from experiments indicate that the base plate of a cartridge case of the above mentioned kind will burst at an internal pressure in an interval of 6-9 MPa static testing and at approximately 11 MPa of dynamic load. Normally, the joint between the shell and cartridge case would be released at an internal pressure in an interval of 4-6 MPa. However, as the insert bonded in the slot of the wall of the cartridge case has no external support when it is not loaded in the barrel, it can not resist any considerable pressure, but will weaken and open up, even in temperatures well below 90° C. when exposed to a relatively low pressure $p_t$ of app. 1 MPa. Alternatively, it might loose its bonding to the shoulder on the edge of the opening. Each insert serves as a perfect sealing 12 of the slot formed openings 8, when the cartridge case 2 is loaded into a barrel. However, it even serves satisfactory during handling and, whenever applicable, transportation and storage of the naked round.

The invention claimed is:

1. A device for preventing an unintentional increase of internal pressure in a round of ammunition comprising a shell, the device comprising:

a base plate;

a cartridge case assembly comprising a cartridge case to be loaded in a barrel of an anti-armour non-disposable weapon, the cartridge case comprising a wall joined to the base plate and comprising a plurality of openings through the wall, wherein the openings are evenly distributed about the wall, and wherein a cross-sectional area of the openings is substantially equal to a cross-sectional area of the base plate; and a plurality of safety members sealing said openings and configured to open up at a predetermined level of pressure.

2. The device according to claim 1, wherein said safety member is configured to open up at a predetermined level of temperature in the cartridge case.

3. The device according to claim 1, wherein the cartridge case comprises metal and the safety member has the shape of an insert of resilient material introduced with a tight fit into the opening.

4. The device according to claim 3, wherein an edge of the opening is stepped in the form of a shoulder and a rim of said insert made with a stepped, complementary form to said shoulder and bonded to the same.

5. The device according to claim 1, wherein the cartridge case is configured as a cylinder.

6. The device according to claim 1, wherein the openings each comprise a longitudinal slot in the cartridge case.

* * * * *